US005230744A

United States Patent [19]

Smith et al.

[11] Patent Number: 5,230,744

[45] Date of Patent: Jul. 27, 1993

[54] METHOD FOR CLEANING BAG MACHINERY

[75] Inventors: David A. Smith, Midland; Clark M. Woody, Bay City; Philip G. Velez, Bay City; Herbert B. Geiger, Bay City; Charles R. Amos, Jr., Auburn, all of Mich.

[73] Assignee: Dowbrands L.P., Indianapolis, Ind.

[21] Appl. No.: 788,002

[22] Filed: Nov. 5, 1991

[51] Int. Cl.[5] ..... B08B 1/02

[52] U.S. Cl. ..... 134/32; 134/42; 134/6; 15/256.51; 271/279

[58] Field of Search ..... 134/42.6, 7, 1, 8, 23, 134/33, 32; 15/256.52, 256.51; 271/279

[56] References Cited

U.S. PATENT DOCUMENTS

| | | | |
|---|---|---|---|
| 3,656,948 | 4/1972 | Mammino | 134/7 |
| 3,883,292 | 5/1975 | Hamaker | 15/256.52 |
| 4,110,035 | 8/1978 | Kamata | 355/15 |
| 4,392,742 | 7/1983 | Landa | 355/15 |
| 4,395,113 | 7/1983 | Buchan et al. | 355/15 |
| 4,757,763 | 7/1988 | MacPhee et al. | 101/425 |
| 4,867,064 | 9/1989 | Mara et al. | 101/425 |
| 4,911,423 | 3/1990 | Smith et al. | 271/279 |
| 4,919,415 | 4/1990 | Smith et al. | 271/284 |
| 4,953,252 | 9/1990 | Akisawa | 15/308 |

FOREIGN PATENT DOCUMENTS

| | | |
|---|---|---|
| 58-142370 | 8/1983 | Japan . |
| 59-15969 | 1/1984 | Japan . |

*Primary Examiner*—Theodore Morris
*Assistant Examiner*—Edward Squillante

[57] ABSTRACT

A method and apparatus for continuous cleaning of bag making machinery is provided. A single roll with a cleaning material attached thereto contacts a rotating drum to remove debris from the surface thereof. When the portion of the cleaning material in contact with the drum becomes saturated with debris, the roll is rotated to present fresh cleaning material to the surface of the drum. The compact design of the cleaning apparatus permits its use in the limited space found around bag making machinery.

11 Claims, 3 Drawing Sheets

METHOD FOR CLEANING BAG MACHINERY

BACKGROUND OF THE INVENTION

The present invention relates to a method and apparatus for removing debris from the surface of a rotating drum, and more particularly it relates to a method and apparatus for removing polymeric degradation products and other materials from the surfaces of plastic bag making machinery.

In the production of individual flexible web products such as plastic bags and containers, the bag stock is typically supplied in the form of a continuous web of thermoplastic material which has been folded upon itself to form two plies. In forming individual plastic bags and containers, portions of the thermoplastic material are severed from the web. These severed areas also become side seams for the bags because they are typically sealed at the same time as they are severed by the use of a heated wire element. The plastic bags are then stacked, counted, and packaged by packing equipment.

The severing and sealing operation typically takes place on a relatively large diameter rotating drum, known as a seal or product drum, which may contain multiple heated wire severing and sealing elements positioned in grooves located within the outer periphery of the drum. As the drum rotates, different severing and sealing elements are actuated to raise them up to the drum surface to sever and seal a respective portion of the web of bag stock. Such heated wire severing and sealing elements are typically maintained at temperatures ranging from 1000° F. to 1300° F. or higher. The individual bags are retained on the drum by a vacuum arrangement as the drum rotates.

Individual bags are then taken from the drum, stacked, and packaged. Presently, individual bags are taken from the drum by a smaller drum, known as a transfer drum, also suitably equipped with vacuum capabilities. The vacuum on the bags on the product drum is relieved at an appropriate point, and the bags are pulled onto the transfer drum and held in position there by vacuum. At an appropriate point, the vacuum is released and the individual bags are pulled off the transfer drum by an orbital packer or similar device.

During the severing and sealing process, a portion of the polymeric bag stock is pyrolized, resulting in the formation of both airborne and melted polymeric particles and polymeric degradation products. The melted polymeric particles and condensed airborne polymeric particles accumulate upon the surface of the product drum, transfer drum, and related machinery to form an ever increasing buildup. As will be appreciated, this polymeric build-up creates substantial operational problems and can affect product quality.

A first problem is that the machinery surfaces may transfer the polymeric material and degradation products to the bag stock being handled, thereby contributing to odor and off-taste in any food which may be later stored therein. In addition, accumulations of the polymeric materials and degradation products on the product and transfer drums clog the vacuum ports thereon, leading to improper bag transfer between the product and transfer drums, as well as resulting in product and equipment jamming. Moreover, such accumulations on the transfer drum in particular induces poor product packaging and frequently causes the packaging equipment which removes individual bags from the transfer drum to jam and otherwise operate improperly.

Presently, the bag making equipment must be shut down frequently and their surfaces cleaned to alleviate product and equipment jams and to rectify packaging malfunctions caused by accumulations of polymeric materials and degradation products on the machinery. Such shut downs are costly both in terms of maintenance expense and in terms of lost production. In addition, poor packaging results in the costly rejection of a substantial percentage of the finished product. Furthermore, the polymeric build-up results in a high degree of inconvenience to the operators of the bag making equipment who are forced to continually cope with the operational and product problems caused by the build-up.

Although the bag making equipment can be shut down and thoroughly cleaned, it is desired to provide a means for continually removing debris from the equipment while the equipment is in operation. Such means would reduce down-time, improve operational and product quality, and minimize rejected product due to poor packaging. Present methods and devices for continuous cleaning of rotating cylinder surfaces in other arts generally provide a cleaning cloth pressed against a cylinder whereby the cleaning cloth is continuously supplied by a supply roll and taken up by a takeup roll.

In U.S. Pat. No. 4,953,252 to Akisawa, for example, a cleaning material strip is fed out from a feed-out roll and is taken up by a takeup roll. Between the feed-out roll and takeup roll, the cleaning material strip is pressed against a roll surface to be cleaned by a pressing mechanism to capture dirt on the roll surface. The cleaning material strip is continuously advanced in a direction counter to the rotation of the roll to be cleaned. Vibration and sucking mechanisms to enhance dirt removal are also disclosed.

U.S. Pat. No. 4,110,035 to Kamata discloses a supply spool and a takeup spool for advancing a web against a photoconductive surface to be cleaned. The web is pressed against the photoconductive surface by a pressure member. A blade is provided to scrape the web from the pressure member to prevent the web from winding around the pressure member.

U.S. Pat. No. 4,757,763 to MacPhee et al. discloses a cleaning cloth supply roller for providing a cleaning cloth to a take-up roll. The cloth is advanced and pressed into contact with a printing blanket cylinder by an inflatable bladder for cleaning the cylinder during the cleaning cycle.

U.S. Pat. No. 4,867,064 to Hara et al. discloses supply and take-up rolls for advancing a cleaning cloth against the direction of rotation of a printing cylinder. A plenum chamber expands to bring the cleaning cloth into contact with the printing cylinder.

Such prior art devices have the disadvantage of occupying a great deal of space in the vicinity of the surface to be cleaned due to the necessity of requiring both a supply and a take-up roll as well as requiring means to press the cleaning cloth into contact with the surface to be cleaned. Such devices have proven to be too large and cumbersome to be used with bag making machines. Due to the number, size, and orientation of the peripheral pieces of equipment which are used in conjunction with bag making machinery (see, e.g., Smith et al. U.S. Pat. Nos. 4,911,423 and 4,919,415) very little space is left for a continuous cleaning device. Such limited space simply does not permit the utilization of the large prior art cleaning devices for the removal of polymeric debris from the surface of the machinery. In addition, while the bag making machinery is in operation, the operator must be permitted to have a clear view of the machinery in order to determine whether adjustments must be made. The cylinder cleaners of the prior art unacceptably block visibility of the bag making machinery due to the amount of space which they occupy.

Another problem with prior art cylinder cleaners concerns accessibility to the bag making machinery. The few unoccupied spaces around the machinery are strategically situated to provide access thereto for any maintenance or adjustments that become necessary. Any continuous cleaner placed in these spaces must be small enough and/or removable to permit access to the bag making equipment. The size, configuration, and immobility of the prior art cleaning devices do not allow such access.

Replacing the cleaning cloth presents an additional problem inherent with the prior art cleaning devices. When the cloth on the feed-out roll has been expended, the used cloth must be removed from the take-up roll, new cloth must be installed on the feed-out roll, and the new cloth must be fed through the cleaning device and attached to the take-up roll. Such a process is difficult and time consuming, further exacerbating production losses due to downtime.

Accordingly, it would be desirable to be able to continuously clean the surfaces of bag making machinery such that the means for cleaning the machinery would easily fit into the available spaces around the machinery to allow for a clear view thereof and physical access thereto. Additionally, the means for cleaning desirably would have a cleaning surface which is quickly and easily changeable. The need still exists in the art for such a method and apparatus for removing polymeric materials and polymeric degradation products from the surfaces of plastic bag making equipment.

SUMMARY OF THE INVENTION

The present invention meets those needs by providing an apparatus for continuously removing debris from the surface of a rotating cylinder which requires only a single contact roll. The contact roll is held against a rotating surface to be cleaned and is enveloped by an easily removable cleaning surface. These features make the present cleaning apparatus compact enough to fit within the small spaces typically found adjacent bag making machinery, allow a clear view of and access to the machinery, and facilitate rapid cleaning material replacement.

According to one aspect of the present invention, an apparatus for cleaning the surface of a rotating drum to prevent the buildup of debris thereon includes a contact roll for contacting the surface of the rotating drum, cleaning material on the surface of the contact roll, means for translating the contact roll from a first position in contact with the surface of the rotating drum to a second position adjacent the drum surface, and means for rotating the contact roll when located at the second position at predetermined intervals to present fresh cleaning material to the drum surface. The rotating drum can be a vacuum product drum for producing plastic bags or a vacuum transfer drum for transferring plastic bags from a vacuum product drum to a bag stacking device. By "debris," we mean the polymeric materials and degradation products which accumulate on the drum surfaces, as well as dust, dirt, or other materials.

The present invention also meets the aforementioned needs in the art by providing a method for cleaning the surface of a rotating drum to prevent the buildup of debris thereon, including the steps of contacting the surface of the rotating drum with a cleaning material secured to the surface of a contact roll, translating the contact roll from a first position in contact with the surface of the rotating drum to a second position adjacent the drum surface, rotating the contact roll to present fresh cleaning material to the drum surface, and translating the contact roll from the second position adjacent the drum surface to the first position in contact with the drum surface. Preferably, the cleaning steps occur automatically at regular, predetermined intervals.

Preferably, the cleaning material is of a type which is adapted to remove polymeric materials from the drum surface. In addition, the cleaning material is removably attached to substantially the entire circumference of the contact roll. A preferred means for attaching the cleaning material to the contact roll is through the use of VELCRO® hook fasteners secured to the surface of the contact roll. The hooks attach to the fibers of the cleaning material to hold the material in place but allow the cleaning material to be quickly removed and replaced when it has become saturated with debris.

Preferably, the means for translating the contact roll from the first to the second position includes a pair of contact arms and means for pivoting the contact arms from a first position in which the contact roll is in contact with the surface of the rotating drum to a second position in which the contact roll is adjacent the drum surface. Each of the contact arms may have a first end and a second end where the first end is pivotably attached to a supporting structure adjacent the rotating drum and the second end is attached to the contact roll.

The means for rotating the contact roll at predetermined intervals preferably includes a motor and motor controller adapted to produce periodic and substantially uniform angular movement, means for mechanically coupling the rotation of the motor with the contact roll, and means for causing the rotation of the motor to occur at predetermined intervals. Preferably, the means for causing the rotation of the motor to occur at predetermined intervals includes a timer for producing an electrical signal at predetermined intervals, means for causing the contact roll to translate from the first position in contact with the rotating drum to the second position adjacent to the surface thereof in response to the electrical signal from the timer, means for sending electric pulses to the motor controller to produce substantially uniform angular movement from the motor in response to the electric signal from the timer, and a counter for counting the number of electric pulses from the pulsing means. The counter produces an electric signal after a predetermined number of pulses is counted. This electric signal from the counter causes the timer to begin timing, the contact roll to translate back to the first position in contact with the rotating drum, and also causes the pulsing means to stop sending pulses to the motor.

Further, the cleaning apparatus includes means for preventing the contact roll from rotating while the contact roll is in the first position in contact with the surface of said rotating drum. This can be achieved by providing a clutch at the point where the contact roll is attached to the contact arms.

Accordingly, it is an object of the present invention to provide an improved apparatus and method for cleaning bag making machinery which is compact in size to fit into limited spaces, to allow visual and physical access to the machinery being cleaned, and which contains a cleaning surface which is easily and quickly replaceable. These and other objects and advantages of the present invention will become apparent from the following detailed description, the accompanying drawings, and the appended claims.

DESCRIPTION OF THE PREFERRED EMBODIMENT

Figure 1:
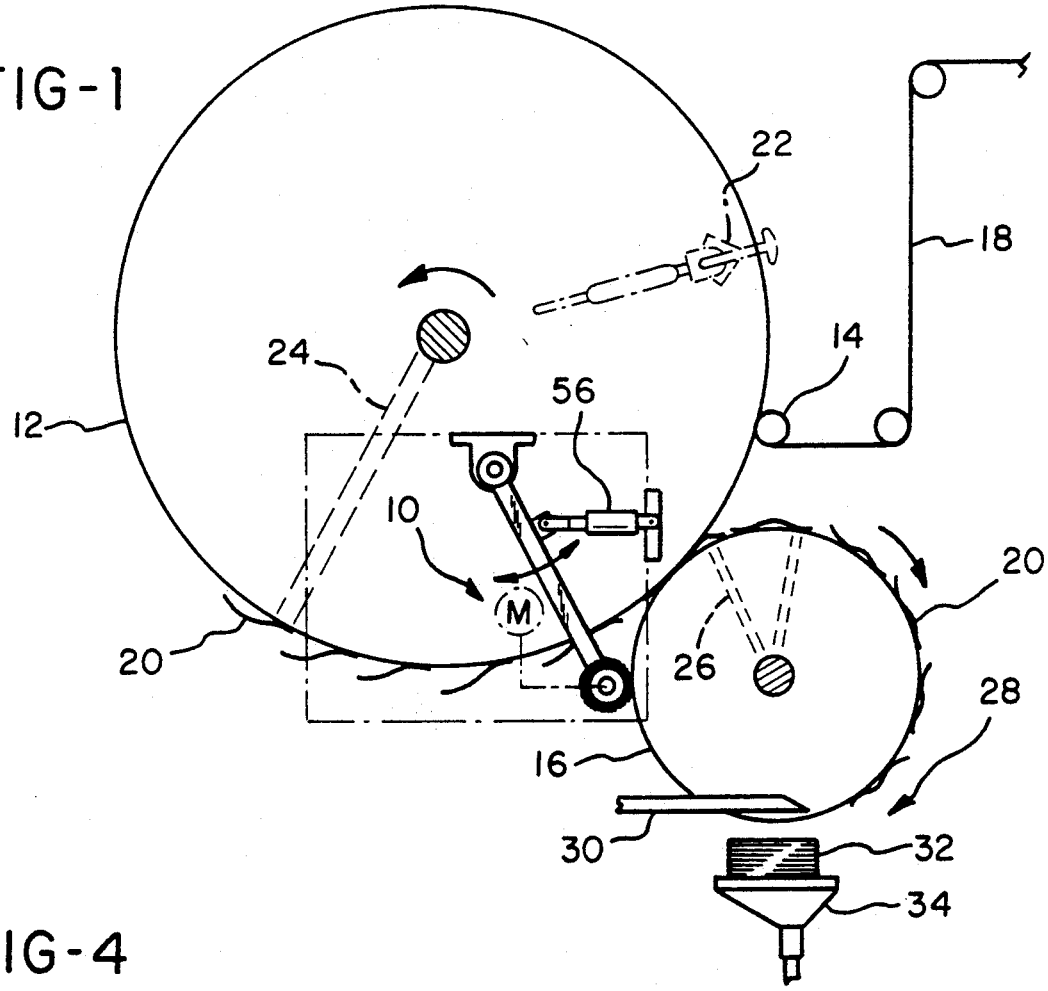
FIG. 1 is a schematic side elevational view of one embodiment of the apparatus for cleaning bag making machinery of the present invention together with a vacuum product drum and a vacuum transfer drum wherein the transfer drum is being cleaned by the cleaning apparatus.

Referring now to FIG. 1, the apparatus for cleaning bag making machinery is illustrated in schematic form. While the apparatus illustrated shows the cleaning of transfer drum 16, it will be apparent to those skilled in the art that a second cleaning apparatus (not shown) may also be mounted to remove debris from the surface of product drum 12, such as by locating it between lay on roll 14 and transfer drum 16. Cleaning apparatus 10 continually removes built up debris and the like from one or both of vacuum product drum 12 and vacuum transfer drum 16. Continuous film web 18 is received onto vacuum product drum 12 around lay on roll 14. Film web 18 is a thermoplastic-type polymeric material from which plastic bags or containers are formed and may either be a zippered or unzippered bag stock being folded on itself to provide a two ply film. Film web 18 is then severed and sealed in a known manner on vacuum product drum 12 to form individual plastic bags 20. As vacuum product drum 12 rotates in the direction of the arrow, a heated wire severing and sealing element, shown generally at 22, emerges from a recess in vacuum product drum 12 and severs film web 18. During this process, the film melts to form a bead seal on the edges of each severed portion of film web 18 to form individual plastic bags 20. Illustrative of this general process for making plastic bags is Smith et al., U.S. Pat. No. 4,911,423, assigned to the same assignee as the present invention, the disclosure of which is hereby incorporated by reference.

Individual plastic bags 20 are held in position on rotating vacuum product drum 12 by vacuum ports, shown generally at 24, which communicate with a vacuum source (not shown). Bags 20 are held onto rotating vacuum transfer drum 16 by a similar vacuum system, represented generally by vacuum ports 26. At a point approximately along a line between the centers of vacuum product drum 12 and vacuum transfer drum 16, the vacuum is relieved from a vacuum port 24 on product drum 12 and activated at a vacuum port 26 on transfer drum 16, causing the bags 20 to transfer from product drum 12 to transfer drum 16.

Individual plastic bags 20 are removed from vacuum transfer drum 16 by packaging device 28. Orbital packer fingers 30 pull the individual plastic bags away from the surface of vacuum transfer drum 16 and deposit the bags onto a stack 32 on delivery table 34. The bags are then transferred to further conventional equipment for final packaging (not shown).

Severing and sealing element 22 is generally maintained at a temperature of between about 1000° F. to about 1300° F. At such temperatures, a portion of film web 18 pyrolizes resulting in the formation of both airborne and melted polymeric particles and polymeric degradation products. The melted polymeric particles and condensed airborne polymeric particles, as well as other airborne dust and dirt, accumulate upon the surface of product drum 12, transfer drum 16, and related machinery (not shown) to form an ever increasing buildup of debris. In the embodiment illustrated in FIG. 1, cleaning apparatus 10 of the present invention is shown removing debris from surface of vacuum transfer drum 16. It is to be understood, however, that the cleaning apparatus of the present invention is equally adaptable to clean the surface of any rotating drum. For example, the present cleaning apparatus can be used to remove debris from the surface of vacuum product drum 12.

Figure 2:
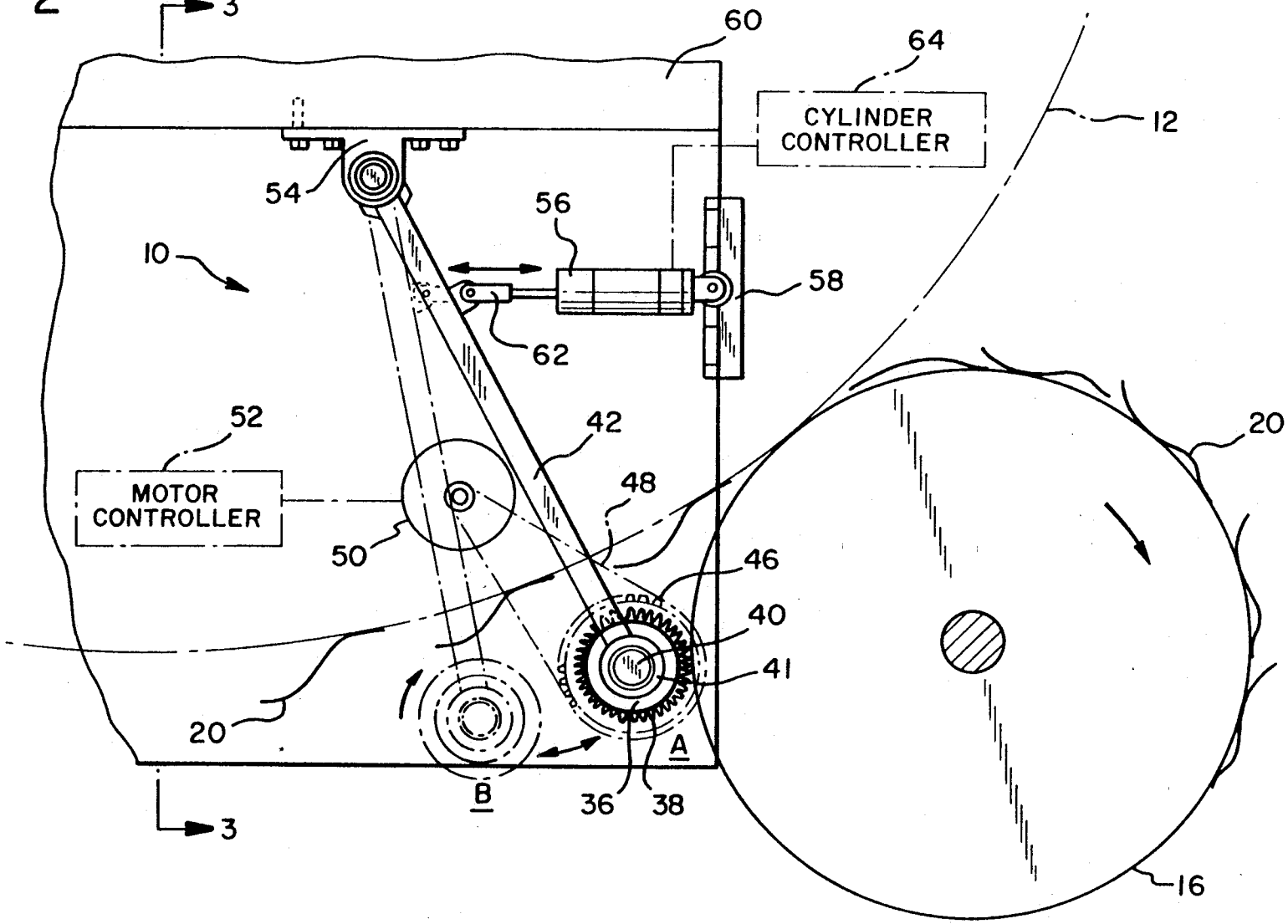
FIG. 2 is a schematic side elevational view of the cleaning apparatus illustrated in FIG. 1 showing a contact arm, a contact roll, a motor, and a pneumatic piston together with a vacuum transfer drum which is being cleaned by the cleaning apparatus.
Figure 3:
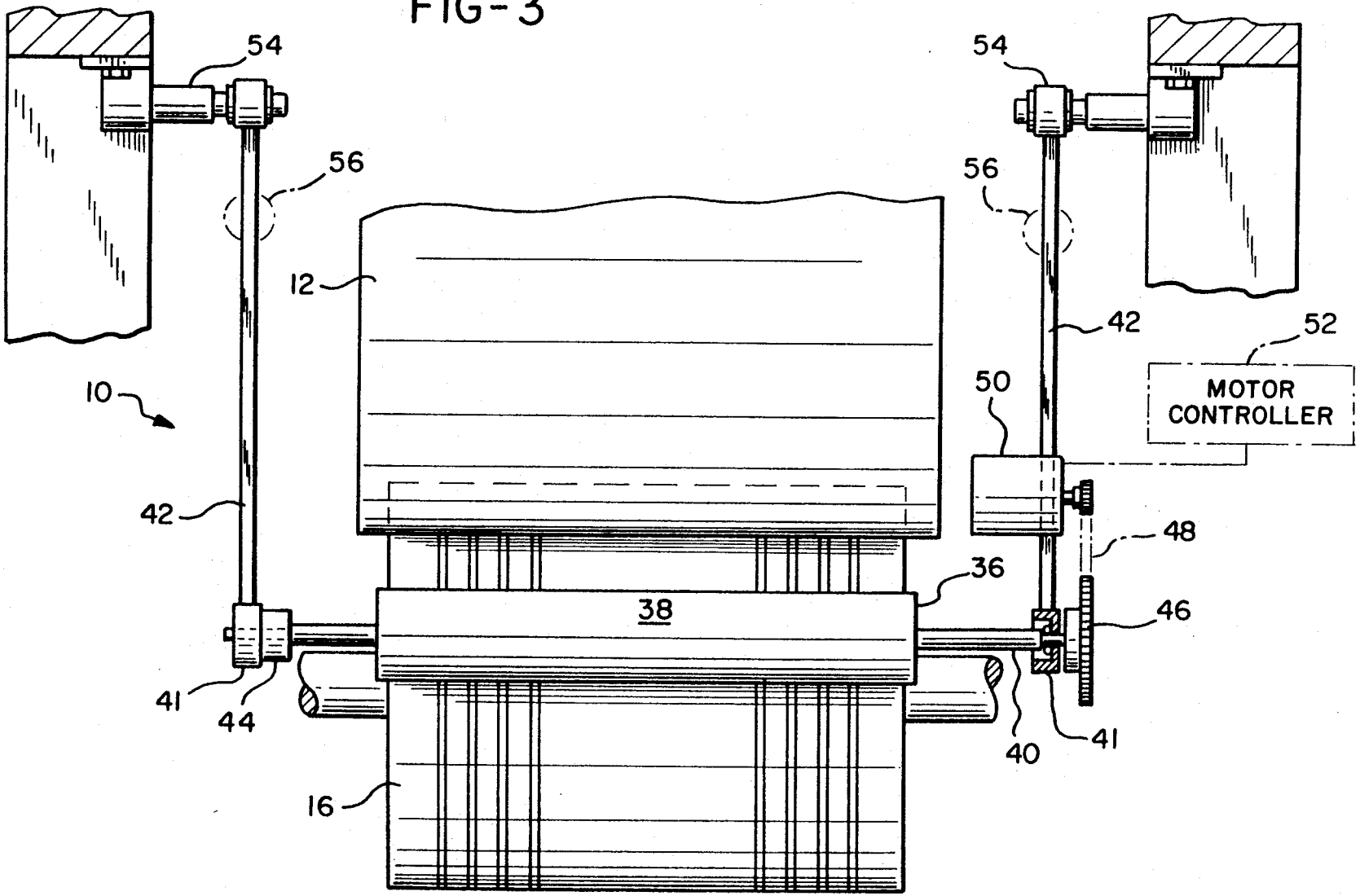
FIG. 3 is an end view of the cleaning apparatus taken along view line 3—3 in FIG. 2.

Referring now to FIGS. 2 and 3, the structure and operation of cleaning apparatus 10 are illustrated in greater detail. The reference numerals in FIG. 1 are applicable to like elements in FIGS. 2 and 3. Cleaning apparatus 10 is shown removing debris from the surface of vacuum transfer drum 16. Cleaning apparatus 10 cleans the surface of vacuum transfer drum 16 just prior to the point where plastic bags 20 are transferred from vacuum product drum 12 to vacuum transfer drum 16. By avoiding the areas where bags 20 are held to vacuum transfer drum 16, this orientation allows contact roll 36 to remain in constant contact with the surface of vacuum transfer drum 16.

Cleaning apparatus 10 removes debris from the surface of vacuum transfer drum 16 by pressing contact roll 36 into contact with the surface of that drum. Disposed upon substantially the entire circumference of contact roll 36 is wiping cloth 38. Wiping cloth 38 can be arranged upon contact roll 36 as one continuous piece of cleaning cloth material or, alternatively, it can be placed upon contact roll 36 in discrete strips where each strip covers the entire circumference of contact roll 36. The latter option minimizes cloth usage by cleaning the surface of transfer drum 16 only in those areas where bags 20 are in contact therewith. Preferably, wiping cloth 38 is a thick, woven material suitable for trapping polymeric particles, dust, and dirt within the fibers thereof. A preferred cloth material is Cleaning and Polishing Cloth Type T, made by the 3M Company. Wiping cloth 38 is held onto the surface of contact roll 36 by the hook component of Velcro® fastener (not shown). In this manner, cloth which has become saturated with polymeric particles and other debris can be replaced easily and quickly, as explained in greater detail below.

Contact roll 36 is fixably mounted on drive shaft 40 which is in turn rotatably supported in sleeves 41 secured to contact arms 42. Clutch 44 prevents drive shaft 40, and therefore also contact roll 36, from rotating in a direction opposite to the direction of rotation of vacuum transfer drum 16 in order to maintain a stationary cleaning surface against vacuum transfer drum 16 as transfer drum 16 rotates. Any foreign particles on the surface of transfer drum 16 are thereby forced into intimate contact with the fibers of wiping cloth 38 to effectuate their removal. In the embodiment of the present invention illustrated in FIGS. 2 and 3, clutch 44 prevents drive shaft 40 and contact roll 36 from rotating in a counter-clockwise direction since vacuum transfer drum 16 rotates in a clockwise direction.

Sprocket 46 is fixably attached to drive shaft 40 in such a manner that drive shaft 40 rotates in sleeve 41 when sprocket 46 is rotated. Chain 48 couples the rotational output of motor 50 to the rotation of sprocket 46 and drive shaft 40. Motor 50 thus causes contact roll 36 to rotate. In the embodiment of the present invention illustrated in FIGS. 2 and 3, motor 50 causes contact roll 36 to rotate in a clockwise direction as indicated by the arrow adjacent the phantom view of contact roll 36. Preferably, motor 50 produces the rotation of contact roll 36 in short and substantially uniform angular movements so that the rotation of contact roll 36 can be controlled with a substantial degree of accuracy. A preferred type of motor for this purpose is a stepper motor. Alternatively, a slow and continuous rotation of contact roll 36 could be produced. As will be described more fully below, the rotation of motor 50 is controlled by motor controller 52.

Contact arms 42 are pivotably attached to pivot brackets 54 and also to pneumatic cylinders 56. Pneumatic cylinders 56 are in turn secured to cylinder brackets 58 (only one of two shown). Pivot brackets 54 and cylinder brackets 58 are mounted on supporting structure 60 adjacent vacuum product drum 14 and vacuum transfer drum 16. Pneumatic cylinders 56 translate push rods 62 horizontally as shown causing contact arms 42 to translate from position A where contact roll 36 is in contact with the surface of transfer drum 16 to position B where contact roll 36 is adjacent the surface of transfer drum 16, and from position B back to position A. Preferably, the translational distance from position A to position B is as short as possible to minimize the functional space occupied by cleaning apparatus 10. Cylinder controller 64 controls the translation of push rods 62 by pneumatic cylinders 56.

Figure 4:
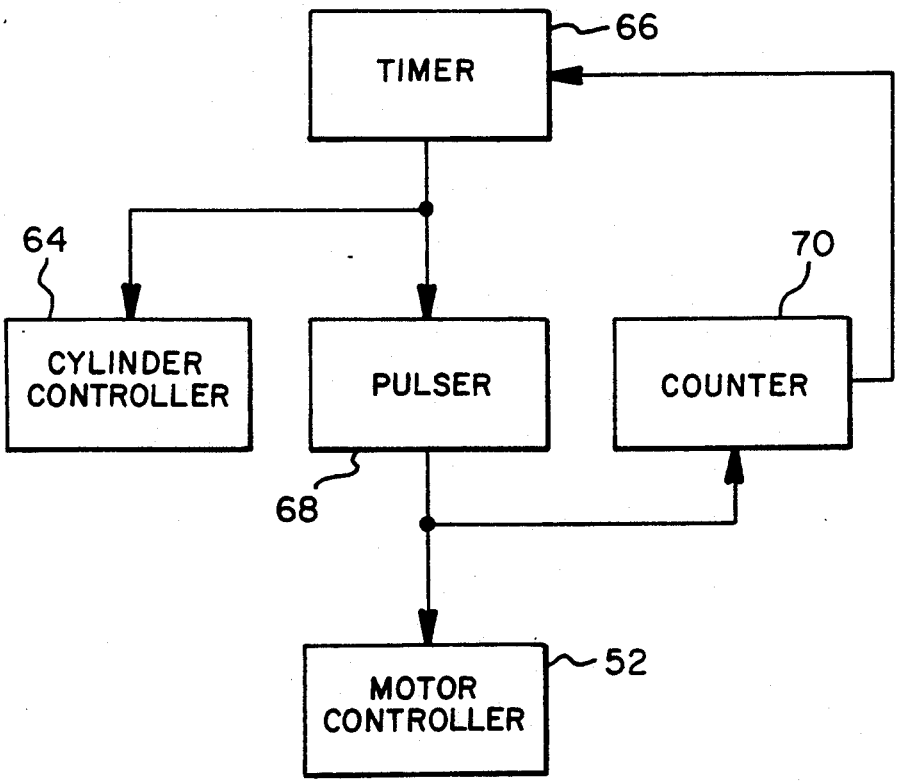
FIG. 4 is a block diagram illustrating the operation and control of the cleaning apparatus of the present invention.

Referring now to FIG. 4, the operation and control of cleaning apparatus 10 is illustrated in block diagrammatical form. Timer 66 times to a predetermined interval. This interval is determined by the operator of vacuum product drum 12 and vacuum transfer drum 16 and is dependent upon the rate at which the portion of wiping cloth 38 in contact with vacuum transfer drum 16 becomes saturated with polymeric particles and other debris.

When timer 66 has timed to the predetermined interval, it sends a signal to cylinder controller 64 and pulser 68. Timer 66, cylinder controller 64, pulser 68, and counter 70 are all commercially available products. Upon receipt of the signal from timer 66, cylinder controller 64 causes pneumatic cylinders 56 to translate contact arms 42 from position A where contact roll 36 is in contact with the surface of vacuum transfer drum 16 to position B as shown in FIG. 2. Simultaneously, pulser 68 begins sending electric pulses to motor controller 52 and counter 70. Upon receipt of each pulse, motor controller 52 causes motor 50 to rotate contact roll 36 about ½°.

Counter 70 counts the number of pulses sent to motor controller 52 from pulser 68. When a predetermined number of pulses is counted, corresponding to a predetermined degree of total rotation of contact roll 36, counter 70 sends a signal to timer 66 causing it to reset itself and to again begin timing the predetermined interval. In addition, upon receipt of the signal from counter 70, timer 66 terminates the signal to cylinder controller 64 and pulser 68 which causes pneumatic cylinders 56 to translate contact arms 42 from position B back to position A and causes pulser 68 to cease sending pulses to motor controller 52.

This sequence of events is continuously repeated so that vacuum transfer drum 16 is presented with a fresh, unsaturated section of wiping cloth 38 at the end of each predetermined interval. Preferably, the total degree of rotation of contact roll 36 during each sequence is about 1°. In this manner, substantially the entire surface area of wiping cloth 38 will be utilized before replacement thereof is necessary.

Alternatively, contact roll 36 could remain in contact with transfer drum 16 without periodically translating from position A to position B. In this manner, contact roll 36 could be rotated slowly and continuously while in contact with the surface of transfer drum 16 or it could be rotated at predetermined intervals while in contact with the surface of transfer drum 16. Either of these options would require a larger, more powerful driving means such as an air or hydraulic cylinder and piston arrangement.

While a representative embodiment and certain details have been shown for purposes of illustrating the invention, it will be apparent to those skilled in the art that various changes in the methods and apparatus disclosed herein may be made without departing from the scope of the invention, which is defined in the appended claims.

What is claimed is:

1. A method for cleaning the surface of a rotating drum to prevent the buildup of polymeric debris, dust or dirt thereon comprising the steps of:

contacting the surface of said rotating drum with a cleaning material secured to the surface of a contact roll;

translating said contact roll from a first position in contact with the surface of said rotating drum to a second position adjacent said drum surface;

rotating said contact roll to present fresh cleaning material to said drum surface; and translating said rotated contact roll from said second position adjacent said drum surface to said first position in contact with said drum surface, thereby presenting fresh cleaning material to said drum surface.

2. The method of claim 1 wherein said rotating drum comprises a vacuum product drum for producing plastic bags.

3. The method of claim 1 wherein said rotating drum comprises a vacuum transfer drum for transferring plastic bags from a vacuum product drum to a plastic bag stacking device.

4. The method of claim 1 wherein said cleaning material is removably attached to substantially the entire circumference of said contact roll.

5. The method of claim 1 wherein said cleaning steps occur automatically at regular intervals.

6. The method of claim 1 wherein said step of translating said contact roll from said first position in contact with the surface of said rotating drum to said second position adjacent said drum surface includes:

providing a pair of contact arms, each said contact arm having a first end and a second end, said first end being pivotably attached to a supporting structure adjacent said rotating drum, said second end being attached to said contact roll;

providing means for pivoting said contact arms from a first position in which said contact roll is in contact with the surface of said rotating drum to a second position in which said contact roll is adjacent said drum surface; and pivoting said contact arms from said first position to said second position.

7. The method of claim 6 wherein said step of translating said contact roll from said second position adjacent said drum surface to said first position in contact with said drum surface includes:

providing means for pivoting said contact arms from said second position in which said contact roll is adjacent said drum surface to said first position in which said contact roll is in contact with the surface of said rotating drum; and pivoting said contact arms from said second position to said first position.

8. The method of claim 1 wherein said step of rotating said contact roll occurs at regular intervals and includes:

providing a motor adapted to produce substantially uniform angular movement;

providing means for mechanically coupling said motor with said contact roll;

providing means for causing the angular movement of said motor to occur at regular intervals; and rotating said motor at regular intervals in substantially uniform angular movements to control the rotation of said contact roll.

9. The method of claim 8 wherein said step of providing means for causing the angular movement of said motor to occur at regular intervals includes:

providing a timer for producing an electrical signal at regular intervals;

providing means for sending electric pulses to said motor to produce said substantially uniform angular movement, said pulsing means sending pulses in response to said electric signal from said timer; and providing a counter for counting the number of electric pulses from said pulsing means, said counter producing an electric signal after a selected number of pulses is counted, said electric signal from said counter casing said timer to begin timing and causing said pulsing means to stop sending pulses to said motor.

10. The method of claim 1 further including the step of preventing said contact roll from rotating while said contact roll is in said first position in contact with the surface of said rotating drum.

11. A method for cleaning the surface of a rotating drum to prevent the buildup of polymeric debris, dust or dirt thereon comprising the steps of:

contacting the surface of said rotating drum with a cleaning material secured to the surface of a contact roll such that said contact roll remains stationary with respect to said rotating drum; and rotating said contact roll at regular intervals to present fresh cleaning material to said drum surface.

* * * * *